United States Patent [19]

Bentley

[11] Patent Number: 4,687,420

[45] Date of Patent: Aug. 18, 1987

[54] SONIC PRESSURE WAVE PUMP WITH LIQUID HEATING AND ELEVATING MECHANISM

[76] Inventor: Arthur Bentley, P.O. Box 238, Capitan, N. Mex. 88316

[21] Appl. No.: 877,456

[22] Filed: Jun. 23, 1986

[51] Int. Cl.[4] ..... E21B 36/04; H05B 6/10

[52] U.S. Cl. ..... 417/240; 166/62; 219/10.49 R; 219/10.51; 219/277

[58] Field of Search ..... 166/57, 60, 62, 302; 417/207, 240, 241; 219/277, 278, 10.65, 10.57, 6.5, 10.49, 10.51

[56] References Cited

U.S. PATENT DOCUMENTS

| | | | |
|---|---|---|---|
| 2,268,978 | 1/1942 | White | 166/62 X |
| 2,405,859 | 8/1946 | Somes | 166/60 X |
| 2,472,445 | 6/1949 | Sprong | 219/10.49 X |
| 4,295,799 | 10/1981 | Bentley | 417/240 |

*Primary Examiner*—Carlton R. Croyle
*Assistant Examiner*—Theodore Olds
*Attorney, Agent, or Firm*—Herbert E. Haynes, Jr.

[57] ABSTRACT

A pump for heating high viscosity oil and elevating it to a ground level from a subterranean level. The pump, which is preferrably of the type which produces and is operated by sonic pressure waves of special character, includes a ground level generator for producing pump operating forces that are transmitted to the subterranean level for reciprocally operating a subterranean heating and oil elevating unit which has a special magnetic piston reciprocal in a non-permanently magnetizable housing for generating heat and further has a reciprocal operating mechanism for intaking the heated oil and elevating it to the ground level.

22 Claims, 7 Drawing Figures

SONIC PRESSURE WAVE PUMP WITH LIQUID HEATING AND ELEVATING MECHANISM

BACKGROUND OF THE INVENTION

1. Field of the Invention

This invention relates in general to pumps and more particularly to a sonic pressure wave pump having a heat generating mechanism for use in heating underground formations and elevating the heated liquids to the ground surface.

2. Description of the Prior Art

Oil wells which are capable of producing only heavy crude oils having a tar-like viscosity, such as those rated at about eleven or so gravity, or higher, have remained caped due to the inability of existing equipment and methods for extracting such oils from the ground in acceptable quantities and at reasonable costs. Even when petroleum is bringing high prices and is in relatively short supply, treating such wells and pumping the oil therefrom remains unprofitable.

Part of the problem associated with extracting the heavy tar-like oils from the ground is the type of pumps which have traditionally been used for oil pumping tasks. The traditional pumps, sometimes referred to as "walking beam pumps" are very expensive to install, operate and maintain. In addition to this, the walking beam pumps simply won't pump the heavy oil without the well being treated in some manner to reduce the viscosity of the heavy oil.

Among the methods that have been used to treat a well so that the heavy oils can be pumped, are injecting solvents or other chemical fluids into the wells, injecting live steam, and the like. Such well treatments have successfully enabled the heavy oils to be pumped, but the extra costs involved and the minimum quantities of oil that can be pumped using such methods has, to the best of my knowledge, caused such well treating to be abandoned. This, of course, resulted in the extensive caping of oil wells of this type.

In addition to the walking beam pumps, another basic approach in pumps has been proposed with a very limited amount of success. Such pumps, which may be classified as "hydraulic pumps", operate by imparting intermittent hydraulic pressure waves on a column of liquid contained in pump tubing which extends from an above ground location to a subterranean source of the liquid to be pumped. The hydraulic pressure waves are generated by an above ground mechanism which reciprocally impacts the column of liquid and, in addition, cyclically opens and closes a liquid delvery port at the above ground location. The hydraulic pressure waves which are generated in this manner, are transmitted by the column of liquid to a downhole pumping device for operation thereof. The downhole pumping device usually includes a plunger or similar mechanism which is biased upwardly by suitable springs and has a central passage formed axially therethrough with a one-way check valve located in the axial passage. When the hydrualic pressure waves impinge on the plunger, it will move down through the liquid to be pumped against the bias of the springs. Such downward movement of the plunger will open the check valve and allow the liquid being pumped to move into the axial passage. The subsequent up strokes of the plunger which occur, under the influence of the biasing springs, between the intermittent hydraulic pressure waves, closes the check valve and causes a general upward movement of the liquid column with the upper end of the column discharging some of the liquid through the cyclically opened delivery port.

Examples of pumping mechanisms which operate generally in the above described maner are disclosed fully in U.S. Pat. Nos. 2,379,539; 2,355,618; 2,428,460; 2,572,977; 2,751,848 and 3,277,381. These pumps critically depend on ideal adjustments of input frequency relative to the length of the pump tubing in which the liquid column is contained. That is, resonant timing. Further, these prior art pumps are seriously limited as to their pumping capacity due to fluid friction, inertia of the liquid, and the like. These shortcomings have kept these types of prior art pumps from achieving any appreciable amount of commercial success and are inoperative in pumping oil of the above mentioned tar-like viscosity.

More recently, another type of pump has been developed which is commonly referred to as a "sonic pump". These pumps employ a special type of above ground generator which cyclically impacts a standing column of liquid contained in the pump tubing to provide a sonic pressure wave as opposed to the above described hydraulic pressure wave. Exactly how these types of pumps work is unknown. It is believed that the sonic pressure waves move downwardly in a spiral-like path about the periphery of the liquid column and impinge on the plunger device of the down-hole pumping mechanism causing it to operate much in the same manner as the plunger used in the above described hydraulic pump. However, instead of the plunger of the sonic pump lifting the column of liquid, it is believed that the liquid is carried to the surface by the sonic pressure waves which are reflected off of the plunger device and move upwardly in a spiral-like path centrally through the column of liquid.

These sonic pumps are fully disclosed in U.S. Pat. Nos. 4,295,799; 4,341,505; 4,381,177; 4,398,870; 4,449,892; 4,460,320; and 4,492,528. Although these pumps have proven to be successful in pumping both oil and water at relatively low installation, operating and maintenance costs, they, like the other pumps discussed briefly above, cannot pump the heavy tar-like oils in the absence of some sort of well treatment.

Therefore, a new and improved pumping device with downhole heating capabilities is needed to overcome some of the problems and shortcomings associated with prior art attempts at pumping heavy oils having tar-like viscosities.

SUMMARY OF THE INVENTION

In accordance with the present invention, a new and useful sonic pressure wave pump with a downhole heating and liquid elevating mechanism is disclosed for use primarily heating heavy oils having tar-like viscosities to reduce the viscosity so that such oils can be efficiently pumped from subterranean levels at costs which makes pumping of this type of oil economically feasible.

The preferred embodiment of the sonic pressure wave pump and the downhole heating and liquid elevating mechanism includes a surface located sonic pressure wave generator which generates the sonic pressure waves in a column of liquid which extends through a surface located output control device to a production tube which extends to a subterranean source of the heavy oil to be pumped. A subterranean heating and liquid elevation assembly is mounted on the depending end of the production tube for operation by the sonic pressure wave which are transmitted thereto through the column of liquid.

The sonic pressure wave generator includes a special piston which is reciprocally operable in a cylinder to cyclically impact the column of liquid to produce the sonic pressure waves which are of special character due to the configuration of the liquid impacting face of the piston. The exact character of the sonic pressure waves is unknown and one theory is that they move into and through the production tube in a spiral-like manner along the inner walls of the production tube. When the sonic pressure waves reach the subterraean heating and liquid elevating assembly, they are reflected back to the surface apparently in a spiral-like manner centrally through the production tube.

The subterranean heating and liquid elevating assembly includes a counterbalancing piston which is reciprocally carried in the bore of a housing. The piston is in engagement with the column of liquid and is biased downwardly in the housing by the head pressure of the column of liquid, by a biasing spring, and its own weight. The piston is disposed so that the sonic pressure waves received from the production tube will impact on the piston and be reflected thereby for the purpose described above. The impact of the sonic pressure waves will cause the piston to move upwardly in the housing due to the counterbalanced configuration of the piston. The upward movement of the counterbalancing piston is accomplished in a series of steps, or jumps, rather than a smooth continuous movement due to the cyclic frequency of the sonic pressure waves.

The counterbalancing piston has an axial bore extending therethrough with a check valve means located therein. When the piston moves downwardly in the liquid, provided in a manner to be described below, the check valve means will open to admit the liquid to the axial bore. When the piston starts its upward stroke, the check valve means closes to trap the liquid in the axial bore so that the reflected sonic pressure waves can carry the liquid to the ground surface.

The subterranean liquid heating and elevating mechanism further includes a plurality of magnets which are mounted in constrained contention with each other on a shaft which depends from the above described counterbalancing piston so as to be reciprocally movable with the piston. To further explain this, the plural magnets are mounted in a repelling attitude, that is, the north pole of one magnet is in contiguous engagement with the north pole of the adjacent magnet and so forth. In such an attitude, the plural magnets will inherently repel each other and this natural tendency is prevented by the magnets being fixed on the shaft to prevent repelling movements. An alternative to this is to form a single magnet having multiple polar regions.

The plural magnets or magnet form what is referred to as a heating and liquid intake piston which is reciprocally movable in the bore of a sleeve that is carried on the depending end of the subterranean heating and elevating mechanism. The sleeve is formed of non-permanently magnetizable material, e.g. highly magnetizable material having little or no residual magnetic properties, such as soft iron, and is provided with an alternating array of annular grooves and fins on its periphery. When the heating and liquid intake piston moves down in the sleeve the liquid to be pumped will move into the sleeve above the heating and intake piston, and when the upward movements start, the liquid will be elevated into the proximity of the counterbalancing piston for movement into the axial bore thereof as described above. The same upward movement of the heating and intake piston causes the production of heat which is radiated and otherwise transmitted into the oil and oil bearing stratum. Just what occurs when the heating and intake-piston is moved up in the series of stepping movements through the sleeve is unknown. It is known however that a considerable amount of heat is produced and the heat reduces the viscosity of the heavy oil so that it can be pumped to ground level.

The surface located output control device is biased so that its liquid output port is normally closed and the sonic pressure waves are transmitted to and through the output control device. The output conrol device will remain closed during a plurality of sonic pressure wave pulses until a predetermined valve of hydrostatic pressure builds up in the subterranean liquid heating and elevating device. While the hydrostatic pressure is building up as a result of the sonic pressure waves, the counterbalancing piston and the heating and intake piston will be moving upwardly in the hereinbefore described stepping, or jumping, motion, and this traps the oil in the axial bore of the counterbalancing piston and generates heat that is radiated into the oil and oil bearing stratum. When the hydrostatic pressure builds up to an amount sufficient to overcome the bias applied to the output control device, the output control device is moved to its open position, e.g. its liquid output port is opened, and transmission of the sonic pressure waves to the output control device and to the subterranean liquid heating and elevating assembly are momentarily interrupted. This momentary interruption of the transmission of the sonic pressure waves continues as long as the output control device is open, and during this time period, the counterbalancing piston and the liquid heating and intake piston will move back to the downwardly disposed positions thereof under the influence of the head pressure of the liquid column. When the output control device is in the open state, the pumped oil will be discharged through the open outlet port thereof due partly to the relieving of the built up hydrostatic pressure and partly to the reflected sonic pressure waves and the oil carried to the surfaces thereby.

From the above, it will be seen that the prior art problems and shortcomings associated with treating wells having heavy tarlike oils so that such oils can be subsequently pumped has been overcome, or at least substantially reduced, in the sonic pressure wave pump with subterranean liquid heating and elevating mechanism of the present invention. the instant mechanism simultaneously accomplishes the treating and pumping of such oils with a significant savings in time and labor and at costs which make the pumping of such oils economically feasible.

Accordingly, it is an object of the present invention to provide a new and useful mechanism for simultaneously treating and pumping oils having a heavy, or tar-like, viscosity.

Another object of the present invention is to provide a new and useful mechanism for the above described purpose which includes a subterranean oil heating and elevating mechanism which produces heat that is radiated and otherwise transmitted into the high viscosity oil and the oil bearing stratum to lower the viscosity thereof and pump that lower viscosity oil to the ground surface.

Another object of the present invention is to provide a new and useful mechanism of the above described character wherein the oil heating objective is accomplished without the need for additional energy input beyond that required to accomplish the oil elevating objective.

Another object of the present invention is to provide a new and useful sonic pressure wave pump having a subterranean oil heating and elevating mechanism wherein the oil heating function and the intaking of the oil is accomplished by a special piston having magnet means wherein multiple pole sets are in contention and the piston is reciprocally moved in the bore of a special sleeve formed of non-magnetic material.

Another object of the present invention is to provide a mechanism of the above described character wherein the mechanism is operated by special sonic pressure waves which are produced by an above ground generator with the sonic pressure waves being transmitted to the subterranean liquid heating and elevating mechanism to accomplish the reciprocal movements necessary to heat and pump the oil to the ground level.

Another object of the present invention is to provide a mechanism of the above described character which further includes an output control device which prevents the output of oil from the subterranean oil heating and elevating mechanism until a predetermined hydrostatic pressure is built up therein whereupon the sonic pressure wave generator is isolated from the rest of the mechanism to allow oil output to occur through the output control device and allow the subterranean oil heating and elevating mechanism to return to its normal position in preparation for a subsequent pressure build up cycle.

The foregoing and other objects of the present invention as well as the invention itself, may be more fully understood from the following description when read in conjunction with the accompanying drawings.

DESCRIPTION OF THE PREFERRED EMBODIMENTS

Figure 1:
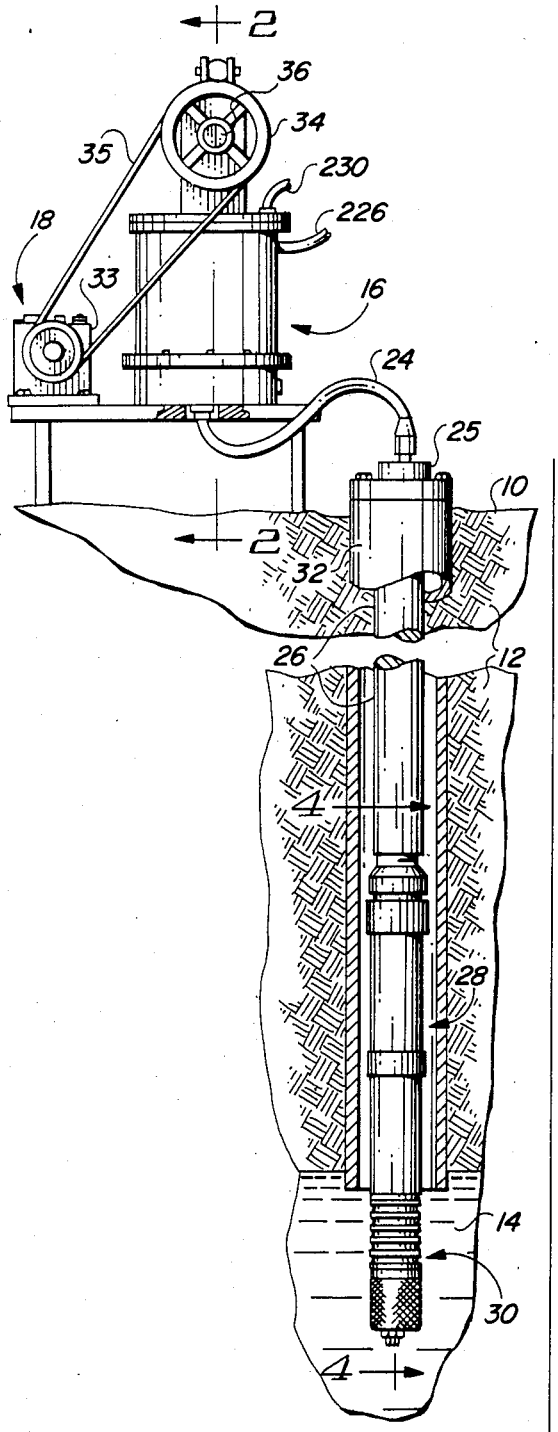
FIG. 1 is a vertical sectional view taken through a ground formation to show the sonic pressure wave pump having the subterranean oil heating and elevating mechanism of the present invention in a typical installation environment.
Figure 2:
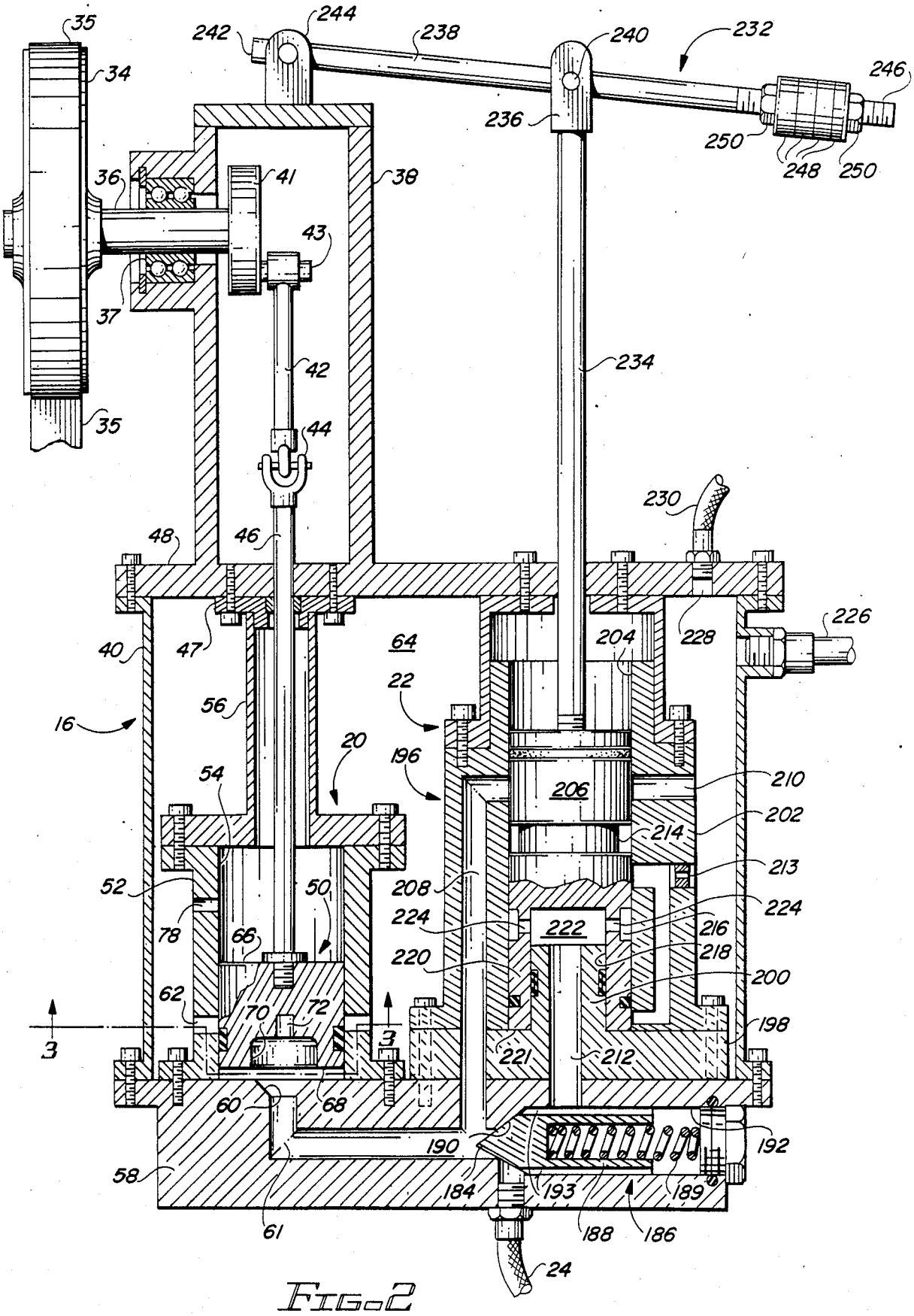
FIG. 2 is an enlarged sectional view taken along the line 2—2 of FIG. 1 to show the various features of the above ground components of the present invention.

Referring more particularly to the drawings, FIG. 1 illustrates a ground formation having a surface level 10, an underground formation 12 in which a source of oil 14 is located. The illustrated formation is intended to be indicative of a stratum in which the oil 14 has a high tar-like viscosity. The sonic pressure wave pump with subterranean oil heating and elevating mechanism of the present invention is located in the ground formation in the conventional manner and is seen to include the major components of an operating and control assembly 16 and a suitable drive means 18 which are at the surface level 10. As shown in FIG. 2, the operating and control assembly 16 includes a sonic pressure wave generator 20, an output control device 22 and a metallic hose 24 coupled between the operating control assembly 16 and the well head 25. THe hose 24 is connected to the upper end of a metallic production tube 26 which depends from the well head 25 into the underground portion 12 of the earth formation and a subterranean heating and liquid elevating assembly 28 is carried on the lower end of the production tube 26 so that the lower end thereof will be in communication with the heavy oil 14.

It will be noted that in accordance with standard practices, the bore of the well is lined with a well casing 32.

The drive means 18, which may be any of several well known mechanisms, is shown for completeness of this disclosure as including a suitable engine 33 which rotatably drives a pulley 34 by means of a belt 35 with the pulley 34 being carried on a drive shaft 36 of the operating and control assembly 16.

As seen in FIG. 2, the drive shaft 36 is journaled for rotation in suitable bearings 37 that are mounted in a drive housing 38 that is provided on top of the main housing 40 which contains the sonic pressure wave generator 20 and the output control device 22. A flywheel 41 is fixedly carried on the inner end of the drive shaft 36. A crank arm 42 is pivotably connected on one of its ends to a pin 43 which is eccentrically mounted on the flywheel 41 and the other end of the crank arm 42 is coupled by means of a suitable universal joint 44 to a connecting rod 46. The connecting rod extends downwardly through a suitable packing means 47 provided in a bore formed through the cover plate 48 of the main housing 40. The other end of the connecting rod 46 is connected to a special piston 50 of the sonic pressure wave generator 20 for reciprocal driving thereof within a cylinder housing 52 having a cylinder bore 54. A shown, the connecting rod 46 extends downwardly from the packing means 47 within a rod enclosing sleeve 56 the bottom of which opens downwardly into the upper end of the bore 54 of the cylinder housing 52.

The sonic pressure wave generator 20 includes the above mentioned special piston 50 which is reciprocally mounted in the cylinder housing 52. The lower end of the bore 54 of the cylinder housing 52 is open and is mounted on top of a liquid coupling housing 58 to place the lower end of the cylinder bore in communication with a sonic nozzle 60 which is provided on the upper end of a passage 61 formed through the liquid coupling housing 58, so that the sonic nozzle opens axially and upwardly into the cylinder bore 54. As will hereinafter be described in detail, the previously mentioned metallic hose 24 is connected between the passage 61 of the liquid coupling housing 58 and the top of the production tube 26. Therefore, the lower end of the cylinder bore 54 below the piston 50 is in liquid communication with the production tube 26 via the sonic nozzle 60, passage 61 of the liquid coupling housing 58 and the hose 24.

The cylinder housing 52 is provided with an annular array of apertures 62 formed therein so that the cylinder bore 54 will be open into the interior 64 of the main housing 40 when the piston 50 is stroked upwardly. The array of apertures 62 form liquid induction ports which allows liquid to flow into the cylinder bore 54 when the piston is stroked up as will hereinafter be described in detail.

The liquid impacting piston 50 includes the usual piston body 66 having a special impact face 68 formed thereon. The impact face 68 has a cavity, or recess, 70 formed axially therein which has been found to be operable in either substantially cylindrical configuration as shown, or in a truncated conical configuration (not shown). In either case, the inner end of the cavity 70 is in communication with a reduced diameter blind cylindrical bore, or socket 72 which extends axially from the cavity into the piston body 66. This, of course, provides the impact face 68 with a substantially ring-shaped configuration.

A standing column of the liquid to be pumped, heated oil to be more specific, is contained in the subterranean liquid heating and elevating assembly 28, the production tube 26 and in the cylinder housing 52 below the piston 50 by virtue of the hereinbefore mentioned hose 24, and the passage 61 formed through the liquid coupling housing 58. Therefore, reciprocal movement of the special piston 50 will cyclically impact the standing column of oil. Due to the special configuration of the impact face 68 of the piston 50, and the sonic nozzle 60, sonic pressure waves generated in this manner move down to the subterranean liquid heating and elevating assembly 28 which, as a result of testing and experimentation, appears to be in a spiral-like path which is disposed adjacent the inner sidewalls of the components which connect the pressure wave generator 20 with the subterranean liquid heating and elevating assembly 28. Further, the sonic pressure waves appear to be reflected by the subterranean liquid heating and elevating assembly so that they travel back up through the center of the various components that extend upwardly to the operating and control assembly 16, and it is believed that these reflected sonic pressure waves carry the oil to be pumped with them to the surface level 10.

It will be understood that the above description of the sonic pressure waves and that movements is hypothetical in that the exact nature and the movement characteristics of the waves is unknown. However, it appears that the waves have both sonic and electrical properties, or characteristics. It is believed that the waves have a sonic characteristic due to the very distinctive sounds that are produced when the pump is working properly and are absent when the pump is malfunctioning, or working improperly. The assumption of the presence of an electric characteristic is based on two phenomena which indicate this. First, all of the components which connect the sonic generator 20 with the subterranean assembly 28 must be electrically conductive or the apparatus simply won't work. By this I mean that the hose 24 must contain an electrical conducting medium such as the braided wire commonly used in high pressure hoses. Also, the production tube 26 must be electrically conductive, e.g. black iron pipe works wherein galvanized pipe doesn't work. The second phenomena is that when a compass is placed beside the hose 24 or the production tube 26, the compass needle will spin through approximately 180° and return to its original position upon the occurrences of each pulse of the sonic pressure waves.

Figure 3:
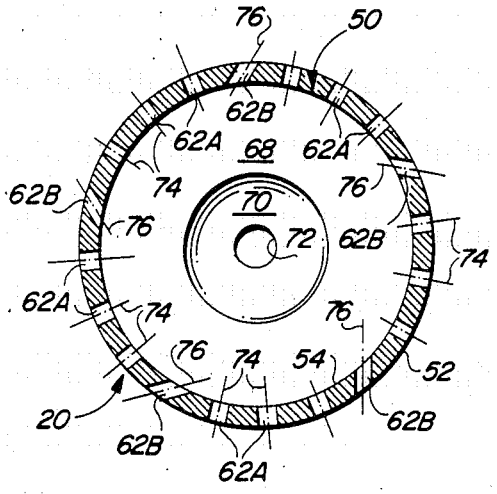
FIG. 3 is an enlarged sectional view taken along the line 3—3 of FIG. 2.

Reference is now made to FIG. 3 wherein a specific preferred configuration of the annular array of apertures 62 of the cylinder housing 52 is shown. The array of apertures is seen to include a plurality of radially disposed apertures 62A, e.g. their axes 74 are radially disposed with respect to the bore 54 of the cylinder housing 52. The array further includes another plurality of especially disposed apertures 62B which are arranged at equal intervals among the radial apertures. The especially disposed apertures 62B have their axes 76 offset from a radial attitude in the manner shown. This arrangement of the apertures improves the effects of the generated sonic pressure waves but what appears to be an intensification of the spiral movement paths.

Although the precise numbers of the apertures 62A and 62B, the exact angular relationship of the axes 76 of the offset apertures 62B, and the like, are not critical, it has been found that when the total number of apertures is 20, with three of the radial apertures 62A between each of the offset apertures 62B, which total five in number and each of the apertures 62B are offset relative to the radial at an angle of about 3–4 degrees, the desired objectives are achieved.

Referring once again to FIG. 2, the cylinder housing 52 is seen to have additional apertures 78 (one shown) located above the piston 50 which places the bore 54 in communication with the interior 64 of the main housing 40. These apertures 78 are for venting purposes.

Figure 4:
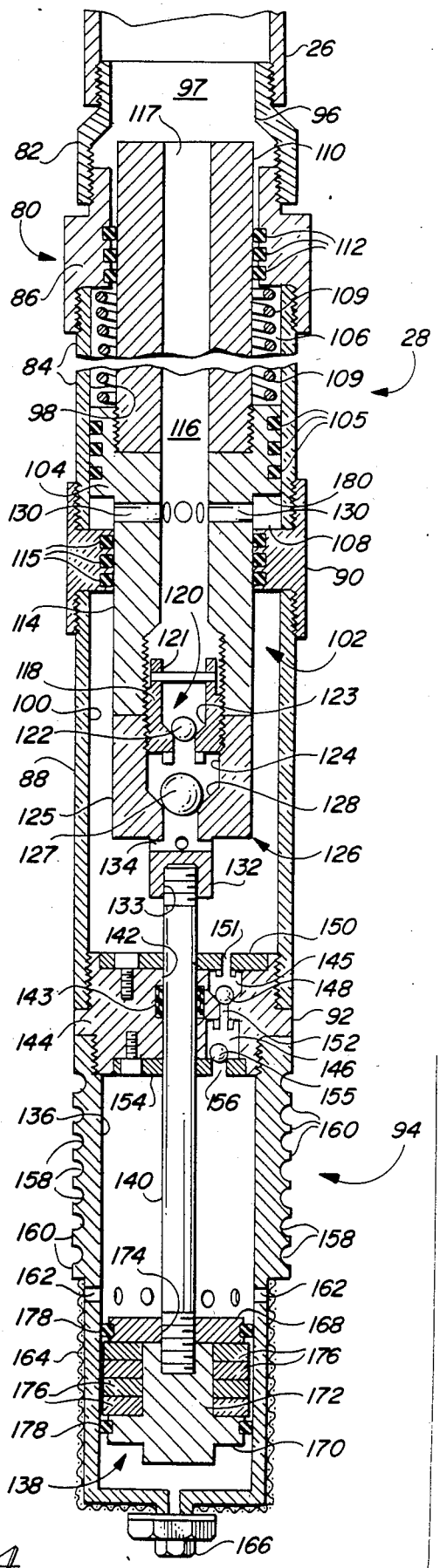
FIG. 4 is an enlarged sectional view taken along the line 4—4 of FIG. 1 to show the various features of the subterranean oil heating and elevation components of the present invention.

Referring now to FIG. 4 wherein the subterranean heating and liquid elevating mechanism 28 is shown in its normal, or downstroke, position. As will become apparent from the following description, the normally downstroked position occurs in the absence of sonic pressure waves.

The subterranean heating and liquid elevating mechanism 28 includes an elongated multi-piece cylindrical housing 80 which comprises an adapter housing 82 on its upper end, a first cylindrical housing segment 84 which is threadingly depending from the adapter housing by means of a first special union 86 a second cylindrical housing segment 88 is threadingly connected to the lowermost end of the first housing segment 84 by means of another special union 90. A third special union 92 is threadingly carried in the lower end of the second cylindrical housing segment 88 and a liquid heating and inlet housing or sleeve 94 is threadingly depending from the third special union 92.

The adapter housing 82 provided on the upper end of the cylindrical housing 80 has a fitting means 96, such as the illustrated threaded boss by which the cylindrical housing 80 is demountably attached to the lower end of the production tube 26. The adapter housing 82 defines an internal chamber 97 which receives the sonic pressure waves from the production tube 26 and also directs the pumped liquid upwardly into the production tube as will hereinafter be described.

The first housing segment 84 defines a cylindrical bore 98 and the second housing segment 88 defines a cylindrical bore 100. As shown, a counterbalancing piston assembly 102 is mounted so as to be reciprocally movable in the internal chamber 97 of the adapter housing 82 and in the bores 98 and 100 of the first and second housing segments 84 and 88 respectively.

The counterbalancing piston 102 includes a piston body 104 having suitable annular seals 105 about its periphery with those seals being in sealed engagement with the walls which define the bore 98 of the first housing segment 84. The bore 98 is divided by the piston body 104 into an upper chamber 106 above the body 104 and a lower chamber 108 below the piston body. A compression spring 109 is provided in the upper chamber 106 so as to exert a downwardly applied bias on the upper surface of the piston body 104. A cylindrical sleeve 110 is attached to the piston body, such as by the illustrated threaded arrangement so as to extend axially upwardly from the piston body 104.

The first special union 86 which interconnects the adapter housing 82 and the first cylindrical housing segment 84 is provided with suitable annular seals 112 which extend into the bore defined by the union and are in sealing engagement with the peripheral surface of the upstanding sleeve portion 110 of the counterbalancing piston 102. Thus, the internal chamber 97 of the adapter housing 82 and the bore 98 defined by the first housing segment 84 are separated from each other and the sleeve 110 extends upwardly from the bore 98 into the chamber 97 of the adapter housing.

The counterbalancing piston assembly 102 further includes a tubular stem 114 which depends axially from the piston body 104. The second special union 90 which threadingly interconnects the first and second housing segments 84 and 88 is provided with suitable annular seals 115 which extend into the bore defined by the union and are in sealed engagement with the peripheral surface of the depending stem portion 114 of the counterbalancing piston 102. Therefore, the bore 98 defined by the first housing 84 is separated from the bore 100 defined by the second housing 88 and the tubular stem 114 extends downwardly from the bore 98 into the bore 100.

As shown, the piston body 104, the upstanding sleeve 110 and the depending tubular stem 114 cooperatively define an axial passage 116 which is open as at 117 on its upper end. The lower end of the axial passage 116 is internally threaded and the housing 118 of a first check valve 120 is threadingly mounted therein. As is customary in check valves of this sort, the housing 118 has an axially extending bore 121 formed therethrough with a ball 122 and ball seat 123 therein. The housing 118 of the first check valve 120 depends from the lower end of the axial passage 116 of the counterbalancing piston 102 with the depending end being in threaded engagement within the axial bore 124 formed through the housing 125 of a second check valve assembly 126 so as to mount the housing 125 on the depending end of the tubular stem 114. The second check valve assembly 126 has the usual ball 127 and ball valve seat 128 in the axial bore 124 thereof.

For reasons which will become apparent as this description progresses, a plurality of radial apertures 130 extend from the axial passage 116 of the counterbalancing piston so as to open into the charging chamber 108 provided in the lower end of the bore 98 of the cylindrical hosing 80. Also, an axially depending boss 132 is provided on the bottom end of the housing 125 of the second check valve assembly 126 and an internally threaded bore 133 extends upwardly into that boss. To accommodate the boss 132 of the check valve housing 125, the axial bore 124 of the second check valve assembly 126 has a plurality of radial apertures 134 extending from the otherwise closed bottom end of the bore 124 through the sides of the depending boss.

The liquid heating and inlet housing 94, which is mounted on the lower end of the second cylindrical housing segment 88 by the third special union 92, defines an axial bore 136 in which a heater piston 138 is reciprocally mounted. The heater piston 138 is coupled to the counterbalancing piston 102 by means of a shaft 140 which extends upwardly from the heater piston 138 and has its upper end in threaded engagement with the internally threaded bore 133 provided in the depending boss 132 of the check valve housing 125. The shaft 140 extends through an axial bore 142 formed through the third union 92. An annular seal 143 is provided in the bore 142 of the union for sealed engagement with the periphery of the shaft 140. Therefore, the bore 100 of the second housing segment 88 is separated from the bore 136 defined by the liquid heating and inlet housing 24.

The special union 92 includes a body 144 through which the above mentioned axial bore 142 is formed. The body 144 also has at least one additional especially configured bore formed therethrough with that bore being configured to provide an axially aligned pair of check valves cavities 145 and 146 therein. The upper check valve cavity 145 has a suitable valve seat formed in the lower end thereof and a ball 148 is disposed in the upper cavity. A top plate 150 is mounted on the upper end of the union body 144 for containing the ball 148 in the upper check valve cavity 145 and a hole 151 is formed in the plate 150 so that the upper check valve cavity 145 opens upwardly into the bore 100 of the second housing segment 88. A passage 152 extends downwardly from the upper check valve cavity 145 to the lower check valve cavity 146. A bottom plate 154 is mounted on the bottom of the union body 144 to contain a ball 155 in the lower cavity 146. A hole 156 is formed through the lower plate 154 so as to be axially disposed with respect to the lower check valve cavity 146 with the upper edge of the hole 156 serving as a seat for the ball 155.

It will be understood that the above described special union 92 may be provided with additional pair so axially aligned check valves (not shown) which are identical to those described immediately above. The additional check valves (not shown) may be provided a various radially spaced increments about the axial bore 142 thereof, and the inclusion of plural check valve arrangements is preferred to insure a free flow of the liquid being pumped from the bore 136 of the liquid heating and inlet housing 94 into the bore 100 of the second housing segment 88, as will hereinafter be described.

As shown, the upper end of the liquid heating and inlet housing 94, which is formed of a non-permanently magnetizable material is provided with a plurality of annular grooves 158 which are machined or otherwise formed about the periphery of the housing. The grooves 158 are spaced axially from each other to provide annular land area, or fins 160, between each of the grooves. The fins 60 aid in radiating heat into the oil and oil bearing stratum and in addition, the alternating arrangement of relatively thin and relatively thick sidewall material of the housing 94 is believed to augment the production of heat as will hereinafter be discussed.

A plurality of radially disposed liquid intake ports 162 are formed in the liquid heating and inlet housing 94 immediately below the lowermost annular fin 160. A suitable screen 164 is mounted on the lower end of the liquid heating and inlet housing 94 so as to cover the liquid intake ports 162 and thereby prevent foreign materials from entering into the housing 94 along with the oil. A vent hole 166 is formed in the lower end of the liquid heating and inlet housing 94 below the special heater piston 138.

The special heater piston 138 includes an upper plate 168 which is threadingly attached to the lower end of the shaft 140 so that the threaded end of the shaft 140 passes through and extends below the upper plate 168. A bottom plate 170 having an axially upstanding reduced diameter boss 172 is provided with an upwardly opening internally threaded axial bore 174 in the top of the boss 172 and the depending end of the shaft 140 is threadingly received in the bore 174. Plurality of magnets 176 are coaxially disposed on the upstanding boss 172 of the bottom plate 170 and are thereby captively contained between the upper and lower plates 168 and 170. the upper and lower plates 168 and 170 are each provided with suitable annular seals 178 which extend from their peripheral surfaces into sealed engagement with the bore 136 of the heating and liquid intake housing 94.

The downhole oil heating and elevating mechanism 28, as hereinbefore mentioned, is shown in its normal downstroked position. This normal downstroked position results from the combination of head pressure forces applied on the counterbalancing piston assembly 102, the biasing force exerted by the compression spring 109 and the weight of the reciprocatingly movable components. The normally downstroked condition occurs in the absence of sonic pressure waves and when sonic pressure waves are received in the subterranean oil heating and elevating assembly 28, upstroking of the reciprocating components will start as a result of the configuration of the counterbalancing piston 102.

As shown, the head pressure forces are felt on the upper end surface of cylindrical sleeve 110 and on the upwardly facing surfaces of the first check valve assembly 120 located in the bottom of the axial passage 116 defined by the counterbalancing piston 102. The head pressure forces applied to those upwardly facing surfaces are partially responsible for the downstroked position, however, those same forces are applied to the downwardly facing annular surface 180, or shoulder, of the piston body portion 104 of the counterbalancing piston 102 and therefore apply an upwardly directed force thereon. The counterbalancing piston 102 is configured so that the surface area of the downwardly facing shoulder 180 is greater than the total surface area of the upwardly facing surfaces of the sleeve 110 and the first check valve 120. Therefore, the actual effect of the head pressure would be to move the counterbalancing piston 102, and of course the special heater and oil intake piston 138, to its upstroked position and that would occur were it not for the spring 109 and the weight of the pistons 102 and 138.

The differences between the upwardly and downwardly facing surface areas of the counterbalancing piston 102 upon which the head pressure forces are felt is predetermined so that when sonic pressure waves are added to the head pressure forces, the upwardly applied force felt on the shoulder 180 will be greater than to total forces of the downwardly applied head pressure forces, the spring 109 and the weight of the reciprocating pistons 102 and 138. Therefore, the pistons 102 and 138 will be moved from the downstroked position to the upstroked position when the sonic pressure waves are received in the subterranean oil heating and elevating mechanism.

It will be appreciated that head pressure forces will be different in wells of different depths and that variable can be compensated for by using compression springs 109 of various values when assembling the mechanism 28 for installation in wells of known depths.

It will further be appreciated that when the counterbalancing piston 102 and the special oil heating and intake piston 138 are being moved from their normal position to the upstroked position, the upward movement will be accomplished in a series of steps or jumping movements due to the cyclic nature of the sonic pressure waves. It is believed that this jumping movement has a direct effect on the heat producing capabilities of the mechanism 28 as will now be discussed.

Figure 5:
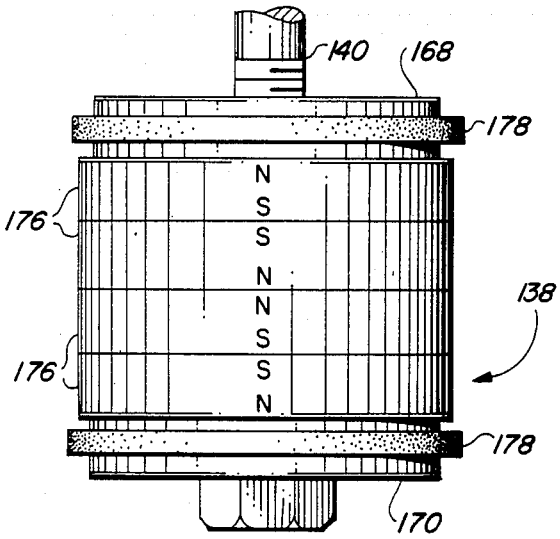
FIG. 5 is an enlarged side elevational view of a first embodiment of the heater piston portion of the mechanism of the present invention.

The plural magnets 176 of the special piston 138 are mounted in contention with each other as shown in FIG. 5 wherein the polarity of the plural magnets 176 are shown. Each of the magnets are of cylindrical ring-shape configuration and each have two polar regions indicated at N and S respectively. The magnets are orientated so that the polar regions are in contention, e.g. like polar regions are proximate each other and thereby produce repelling magnetic fields.

Figure 6:
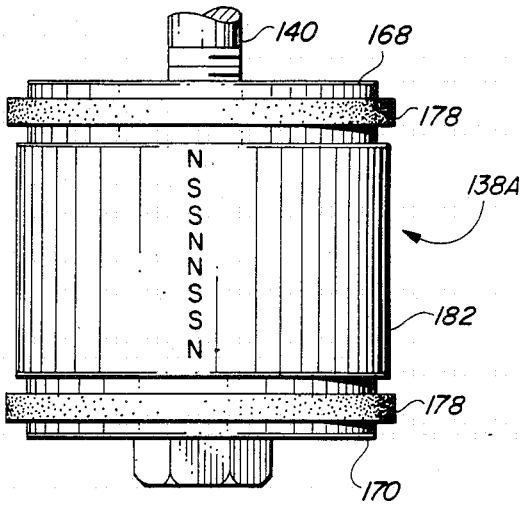
FIG. 6 is a view similar to FIG. 5 but showing a second embodiment of the heating piston portion of the mechanism of the present invention.

As is known, it is possible to magnetize a single body of magnetizable material so as to provide plural polar regions in the single piece of material. The modified piston 138A, as shown in FIG. 6, is formed with a single magnet 182 of axially elongated cylindrical configuration which has been magnetized to provide plural polar regions therein which are indicated, in the same manner as in FIG. 5, at N and S.

Figure 7:
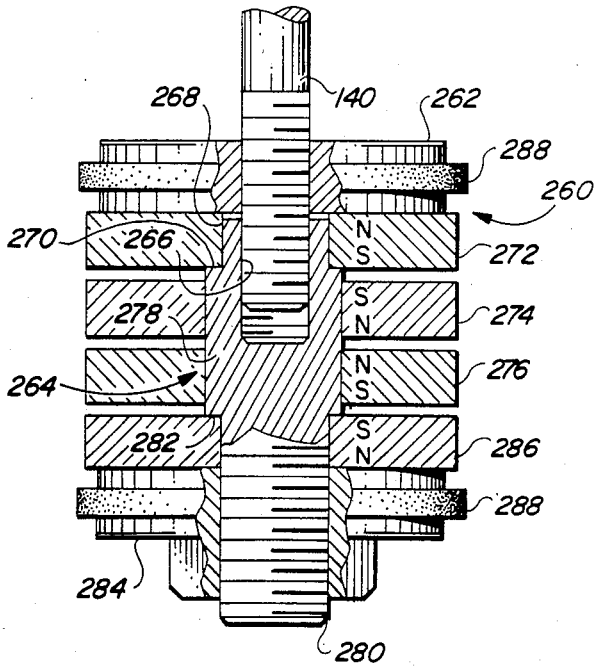
FIG. 7 is a view similar to FIG. 5 and 6 with portions thereof being in section to show the various features of a third embodiment of the special heading and liquid intake piston portion of the present invention.

A third embodiment of the special heater piston is indicated generally by the reference numeral 260 in FIG. 7. The piston 260 includes an upper plate 262 which is threadingly carried on the lower end of the shaft 140 with the lower end of the shaft being disposed to extend axially below the upper plate 262. A cylindrical body 264 is formed with an internally threaded axial bore 266 on its upper end and the body 264 is threading mounted on the lower end of the shaft 140. The body 264 is provided with a reduced diameter portion 268 on its upper end to form a first annular shoulder 270. A first ring-shaped magnet 272 is coaxially mounted on the reduced diameter portion 268 of the body 264 so as to be mounted fast between the lower surface of the upper plate 262 and the first annular shoulder 270. Second and third ring-shaped magnets 274 and 276 are coaxially mounted on the full diameter main body portion 278 of the body 264 in a manner which will hereinafter be described in detail. The body 264 further includes an externally threaded stud 280 which extends axially and downwardly from the main body portion and forms a second annular shoulder 282 which faces oppositely with respect to the first annular shoulder 270 of the body. A bottom plate 284 is threadingly mounted on the stud portion 280 of the body 264 and another ring-shaped magnet 286 is coaxially mounted on the stud 280 so as to be mounted fast between the second shoulder 282 of the body and the upper surface of the bottom plate 284. Both the upper and bottom plates 262 and 284 are of disc-like configuration and are configured to carry annular seals 288 for sealed engagement with the bore 136 of the liquid heating and inlet housing 94 in the manner hereinbefore fully described.

As shown, the length dimension of the full diameter main body portion 278 of the body 264 is greater than the combined thickness dimensions of the two ring-shaped magnets 274 and 276 that are mounted thereon. Therefore, annular spaces are provided between each of the magnets 272, 274, 276 and 286. Due to the magnets being arranged so that they are in contention, as indicated by the polar region identification in FIG. 7, the two centrally located magnets 274 and 276 will float axially relative to each other and to the fixedly mounted end magnets 272 and 286.

It has been found that by providing the special piston 260 with the fixed and floating magnets, as described above, the floating magnets 274 and 276 will move in what may be described as a dancing or jiggling motion when the piston 260 is reciprocally moved in the bore 136 of the heating and liquid intake housing 94. The dancing or jiggling movement of the floating magnets 274 and 276 has the same effect as the hereinbefore described stepping or jumping movements applied by the sonic pressure wave pump to the piston during upstroking thereof. Thus, the dancing movement of the floating magnets will augment the stepping movements of the piston and increase the total heat output thereof.

When the piston 138, 138A or 260 is moved through the especially configured heating and liquid inlet housing 94, in the above described stepping movement, a considerable amount of heat is produced as mentioned above and the amount is significantly greater than the amount normally attributed to magnetic effects, as a result of hysteresis and the like. The reasons for the increase in heat production are not know, but it is believed to be the result of various interacting factors. If the polar regions of the magnets are arranged in the normal North to South relationship, then the heat produced is minimal, e.g. in an amount normally attributed to the magnetic effects. Therefore, arranging the polar regions in contention is an indispensible factor. Fabricating the housing 94 of a non-permanently magnetizable material, such as soft iron and providing it with the alternating material thicknesses produced by the annular grooves 158 and the fins 60, are contributing factors as is the stepping, or jumping, movement of the piston, and dancing movement in the case of the piston 260.

When the heating and oil intake piston 138, 138A or 260 moves down it to the bore 136 of the housing 94 to a point where the liquid intake ports 162 thereof are opened, the heated oil will be sucked into and will otherwise flow into the bore 136 above the piston. When the piston is subsequently moved up, the oil, and possible gasses, which are trapped in the bore 136 upon closing of the intake ports 162 will be moved up through the axially aligned pairs of check valves formed through the special union 92. Thus, this oil will be received in the bore 100 defined by the second housing segment 88. When the counterbalancing piston 102 is moved down, the depending tubular stem portion 114 thereof will move down through the oil that is received in the bore 100. This causes the check valves 120 and the second check valve assembly 126, both of which are carried on the stem 114, to open thereby admitting the oil into the axial passage 116 defined by the counterbalancing piston 102. The oil admitted to the axial passage 116 is now in a position where it can be carried upwardly through the production tube 26 by the reflected sonic pressure waves.

Reference is made once again to FIG. 2 for the following description of the hereinbefore mentioned output control device 22. The sonic pressure waves which are supplied to the hose 24 by the sonic pressure wave transmitting passage 61 formed in the liquid coupling housing 58 will impact on the conical face 184 of an interrupter valve 186 prior to being supplied to the hose 24. The interrupter valve 186 includes a plunger 188 which is biased by a suitable spring 189 so that the conical face 184 will be normally seated on a valve seat 190 that is provided between the passage 61 and an axially aligned bore 192 in which the plunger is movably carried. The plunger 188 is fluted about its periphery to provide a plurality of longitudinally extending passages 193. Therefore, the portions of the conical face 184 proximate the base thereof are in direct communication with the portion of the bore 192 which is located behind the plunger 188, e.g. to the right in FIG. 2, via the longitudinal passages 193.

When the sonic pressure waves impact on the face 184 of the plunger 188, the plunger will be unseated to admit the pressure waves to the hose 24 and thus into the bore 192 behind the plunger. In this manner, the plunger 188 will be unseated upon the occurrence of each sonic pressure wave and will be reseated between each pressure wave. By allowing the generated sonic pressure waves to be admitted to the subterranean oil heating and elevating mechanism 28, that mechanism will be operated to produce an upstroking of the mechanism. However, the reflected pressure waves and the oil caried to the surface thereby will be prevented from escaping due to the operation of a relief valve assembly 196 as will be described below. And, this results in a build-up of what is referred to herein as hydrostatic pressure. The hydrostatic pressure build-up will be felt throughout the upper portions of the subterranean oil heating and elevating mechanism 28, the production tube 26, the hose 24 and the bore 192 behind the plunger 188.

In addition to the interrupter valve 186, the output control device 22 includes the previously mentioned relief valve assembly 196. The relief valve assembly 196 includes a base plate 198 which is mounted on the liquid coupling housing 58 and has a cylindrical boss 200 extending normally therefrom. A relief valve housing 202 is mounted on the base plate 198 and defines a cylindrical bore 204 into the lower end of which the cylindrical boss 200 of the base plate 198 coaxailly extends and in which a relief piston 206 is reciprocally movable.

A sonic pressure wave bypass passage 208 is cooperatively formed by the liquid coupling housing 58, the base plate 198 and the relief housing 202 so as to have one end open into the sonic pressure wave transmitting passage 61 of the coupling housing 58 at a point between the sonic nozzle 60 and the interrupter valve 186. The other end of the bypass passage 208 opens into the upper end of the bore 204 of the relief housing 202 and has an open bypass outlet port 210 on the diametrically opposed side thereof.

Also, a relief passage 212 is cooperatively formed by the coupling housing 58 and the base plate 198 so that one end thereof is in open communication with the bore 192 of the interrupter valve 186. The relief passage 212 extends axially through the boss 200 of the base plate 198 and opens onto the extending end thereof. Further, a restricted relief port 213 extends from the bore 204 of the housing 202 so as to open exteriorly thereof.

The relief piston 206 has a first annular groove 214 and an axially spaced second annular groove 216 both being formed about the periphery thereof. Also, the piston 206 has a blind bore 218 extending axially therein and the cylindrical boss 200 is axially disposed in the blind bore 218. The blind bore 218 of the piston is defined by a skirt 220 the extending end 221 of which is in engagement with the base plate 198 in the normal position of the relief piston 206 to serve as a stop and therefore provide a chamber 222 between the extending end of the boss 200 and the inner end of the blind bore. A plurality of ports 224 extend radially from the chamber 22 into the second annular groove 216 of the piston 206.

The relief piston 206 is biased downwardly, as will hereinafter be explained, into its normal position which is shown in FIG. 2. In its normal position, the sonic pressure wave bypass passage 208 will be closed by the relief piston 206. The relief passage 212 is also closed by virtue of the second annular groove 216 of the piston 206 being out of alignment with the relief port 213 of the housing 202 which, as seen, closes the second annular groove 216, the chamber 22 and thus the relief passage 212.

As the hydrostatic pressure builds up in the upper end of the subterranean oil heating and elevating mechanism 28 and in the bore 192 of the interrupter valve 186 behind the plunger valve 188 thereof as hereinbefore described, the pressure will also build up in the chamber 222 by means of the fluted passages 193 of the plunger valve 188 and the relief passage 212. When the pressure builds up in the chamber 222 at the inner end of the blind bore 218 of the relief piston 206, it will exert a force on inner end surface of blind bore 218 and that force is in opposition to the biasing force applied on the relief piston 206. When the hydrostatic pressure builds up to a point where the force applied thereby on the relief piston 206 exceeds the biasing force applied thereon, the relief piston 206 will move to bring the first annular groove 214 into an aligned position between the by-pass passage 208 and bypass outlet port 210. Also, when moved, the relief piston 206 will be disposed so that its second annular groove 216 will be aligned with the relief port 213 of the valve housing 202.

Therefore, when the relief piston 206 is moved in the above described manner, the generated sonic pressure waves will take the path of least resistance and will move through the bypass passage 208, the first annular groove 214 of the piston 206 and will pass through the bypass outlet port 210 into the interior 64 of the main housing 40 of the operating and control mechanism 16. Also, hydrostatic pressure buildup in the subterranean oil heating and elevating mechanism and in the output control device will be relieved into the interior 64 of the housing and this allows the heated oil which was carried to the surface by the reflected pressure waves to escape into the interior 64 of the main housing, and ultimately pass through a product delivery conduit 226 to a suitable delivery point (not shown). A gas venting port 228 is provided on the main housing 40 so that any gas which moved to the surface with the oil can be vented to atmosphere or carried to a suitable collector (not shown) by means of a hose 230 or the like.

As hereinbefore mentioned, the relief piston 206 is biased to its downstroked closed position shown in FIG. 2, and that biasing is preferrably accomplished by means of an adjustable biasing assembly 232. The biasing assembly includes a shaft 234 which extends axially from the relief piston 206 through the cover plate 48 of the main housing 40, and has a suitable clevis 236 on its distal end. A swing arm 238 is mounted intermediate its opposite ends in the clevis 236 by means of a pivot pin 240. One end 242 of the swing arm 238 is pivotably mounted in a yolk 244 which is fixedly mounted on the housing 38 of the drive means 18. The opposite end of the swing arm 238 is free and is threaded, as indicated at 246, and a plurality of disc-shaped weights 248 are mounted on the free end of the swing arm and are held thereon by suitable nuts 250. Thus, the weights 248 carried by the swing arm 238 will exert a downwardly applied force on the shaft 234 and thereby bias the relief piston 206 to its downstroked, or closed, position. The biasing force can be adjusted to suit particular installations by removing or adding weights to the free end of the swing arm 238.

Although the above described sonic pressure wave pump with the liquid heating mechanism is the preferred embodiment of the present invention, the liquid heating mechanism per se can be operated by other types of pumps to accomplish the desired heating of subterranean high viscosity oil deposits. For example, the prior art pumps hereinbefore described as being commonly referred to as "walking beam pumps" impart a push-pull type of movement, which is generated at an above ground level, and transmitted by a string of rods, referred to as "sucker rods", to a downhole pumping device, the reciprocating movement of the sucker rods, can be utilized to operate the special heating mechanism of the present invention. If the pistons 138 or 138A are used in conjunction with a walking beam pump an escapement mechanism would need to be included to obtain the stepping, or jumping, movement of those pistons. If the special piston 260 is used with a walking beam pump, or other similar pump, the dancing or jiggling movement of the floating magnets 274 and 276 will suffice.

While the principles of the invention have now been made clear in the illustrated embodiments, there will be immediately obvious to those skilled in the art, many modifications of structure, arrangements, proportions, the elements, materials and components used in the practice of the invention and otherwise, which are particularly adapted for specific environments and operation requirements without departing from those principles. The appended claims are therefore intended to cover and embrace any such modifications within the limits only of the true spirit and scope of the invention.

What I claim is:

1. A pump mechanism for heating and elevating high viscosity subterranean oil comprising:

(a) power means for producing pumping forces;

(b) transmitting means coupled to said power means for receiving the pumping forces therefrom and transmitting them to a position proximate the subterranean oil to be heated and elevated;

(c) pump means coupled to receive the pumping forces from said transmitting means and including operating means for responding to the received pumping forces by producing oil elevating reciprocal movements, said operating means including, I. a housing defining an axial bore and formed of a non-permanently magnetizable material and having alternately arranged annular grooves and fins formed axially along the periphery thereof, II. a piston in the bore of said housing for reciprocal movement with said operating means, said piston having magnet means defining a plurality of polar regions arranged to be in contention with each other for generating heat when said piston is reciprocally moved in the bore of said housing; and (d) means for producing irregular movements of said piston during at least one stroke of the reciprocal movement thereof.

2. A pump mechanism as claimed in claim 1 wherein said magnet means of said piston is in the form of a plurality of individual magnets and said piston means includes means for fixedly holding said plurality of individual magnets in contiguous engagement with each other.

3. A pump mechanism as claimed in claim 1 wherein said magnet means of said piston is in the form of a single magnet which is formed with a plurality of polar regions therein with said forming being accomplished so that said plurality of polar regions are in contention with each other.

4. A pump mechanism as claimed in claim 1 wherein said magnet means of said piston includes a plurality of individual magnets at least one of which is free to move in a jiggling motion to provide said means for producing irregular movements of said piston.

5. A pump mechanism as claimed in claim 1 wherein said piston comprises:

(a) magnet mounting means defining an axis;

(b) a pair of magnets fixedly mounted by said magnet mounting means in spaced apart relationship on the axis defined thereby; and (c) at least one additional magnet loosely mounted by said magnet mounting means in the space between said pair of fixedly mounted magnets for free jiggling movement within the space between said pair of fixedly mounted magnets for producing at least a portion of said means for producing the irregular movements of said piston.

6. A pump mechanism as claimed in claim 5 and further comprising said power means being a sonic pressure wave generator with the pumping forces produced thereby being in the form of cyclically generated sonic pressure waves which result in said piston moving in steps during at least one of the strokes of its reciprocal movement for augmenting the irregular movements provided by the jiggling movement of said additional magnet of said piston.

7. A pump mechanism as claimed in claim 1 and further comprising said power means being a sonic pressure wave generator with the pumping forces produced thereby being in the form of cyclically generated sonic pressure waves which results in said piston moving in steps during at least one of the strokes of its reciprocal movement to provide at least a portion of said means for producing the irregular movements of said piston.

8. A sonic pressure wave pump for heating and elevating high viscosity oil from a subterranean level and having a column of liquid therein, said pump comprising:

(a) a sonic pressure wave generator having a reciprocally operable piston for cyclically impacting the column of liquid;

(b) a metallic production tube coupled to said generator and extending downwardly toward the subterranean level;

(c) said piston of said generator having a central recess in its liquid impacting face for generating sonic pressure waves which move downwardly in the column of liquid;

(d) a subterranean heating and liquid elevating assembly on the depending end of said production tube proximate the high viscosity oil to be heated and elevated, said assembly having means for impingingly receiving the downwardly moving sonic pressure waves and reflecting them upwardly through said production tube, said means of said assembly responding to the impinging sonic pressure waves by reciprocally moving substantially smoothly in one direction for heating and intaking the oil to allow the reflected sonic pressure waves to carry the oil upwardly therewith; and (e) said means of said heating and liquid elevating assembly including, I. a sleeve housing defining an axial bore and formed of a non-permanently magnetizable material and having alternately arranged annular grooves and fins formed axially along its periphery, II. a heater piston in the bore of said sleeve housing and having magnet means defining a plurality of polar regions which are arranged in contention with each other for generating heat when said heater piston moves reciprocally in the bore of said sleeve housing.

9. A pump as claimed in claim 8 wherein said magnet means of said heater piston is in the form of a plurality of individual magnets and said heater piston includes means for fixedly holding said plurality of individual magnets in contiguous engagement with each other.

10. A pump as claimed in claim 8 wherein said magnet means of said heater piston is in the form of a single magnet having the plurality of polar regions formed therein so as to be in contention with each other.

11. A pump as claimed in claim 8 wherein said magnet means of said heater piston includes a plurality of individual magnets at least one of which is free to move in a jiggling motion.

12. A pump as claimed in claim 8 wherein said heater piston comprises:

(a) magnet mounting means defining an axis; and (b) said magnet means including, I. a pair of magnets fixedly mounted by said magnet mounting means in spaced apart relationship on the axis defined thereby, II. at least one additional magnet loosely mounted by said magnet means in the space between said pair of fixedly mounted magnets for free jiggling movement within the space between said pair of fixedly mounted magnets.

13. A pump as claimed in claim 8 and further comprising an output control means interposed between said generator and said production tube and having an oil outlet, said output control means having a normal first position wherein the generated sonic pressure waves from said generator will move downwardly for operation of said heating and liquid elevating assembly and the oil outlet of said output control means is out of communication with said production tube, said output control means being responsive to a hydrostatic pressure build-up in said production tube for movement to a second position wherein the downward movement of generated sonic pressure waves is interrupted and the oil outlet of said outlet control means is in communication with said production tube.

14. A pump as claimed in claim 13 wherein said output control means comprises:

(a) an interrupter valve interposed between said generator and said production tube and being movable between a normally closed position and an open position; said interrupter valve being disposed so that the generated sonic pressure waves will move it to its open position upon the occurrence of each generated sonic pressure wave to allow downward movement thereof;

(b) a relief valve interposed between said production tube and the oil outlet of said output control means and being movable from a normally closed position and an open position, said relief valve being disposed to receive the reflected sonic pressure waves and the oil carried thereby and remain closed until the hydrostatic pressure in said production tube builds up to a predetermined valve whereupon said relief valve moves to the open position to place said production tube in communication with the oil outlet of said output control means; and (c) bypass means interposed between said generator and said relief valve so that the generated sonic pressure waves will move said interrupter valve to its open position when said relief valve is closed and will bypass the generated sonic pressure waves when said relief valve is open so that said interrupter valve will remain closed when said relief valve is open.

15. A pump as claimed in claim 14 and further comprising adjustable biasing means for adjustably setting the predetermined value at which said relief valve will move to its open position.

16. A pump as claimed in claim 8 wherein said means of said heating and liquid elevating assembly further comprises:

(a) a housing depending from the lower end of said production tube and defining a bore having upper and lower ends the upper end of which is in communication with said production tube;

(b) said sleeve housing being mounted so as to depend from said housing and having oil intake openings through which the oil to be elevated will flow into the upper portion of the bore of said sleeve housing above said heater piston when said heater piston is in a downstroked position of its reciprocal movement;

(c) a plunger in the bore of said housing for impingingly receiving the generated sonic pressure waves and responding by reflecting the received sonic pressure waves and by reciprocally moving in the bore of said housing, said plunger having axial passage;

(d) said heater piston being coupled to said plunger for reciprocal movement therewith;

(e) first check valve means between the lower end of the bore of said housing and the upper end of the bore of said sleeve housing to allow the oil in the upper end of the bore of said sleeve housing to flow into the lower end of the bore of said housing when said plunger and said heater piston are moved to the upstroked position;

(f) second check valve means in the axial passage of said plunger to allow the oil in the lower end of the bore of said housing to move into the axial passage of said plunger when said plunger and said heater piston are moved to the downstroked position thereof; and (g) said plunger including means for utilizing the head pressure of the liquid column of said pump for counterbalancingly biasing said heater piston and said plunger upwardly with a force which is less than the downwardly directed head pressure forces plus the weight of said plunger and said heater piston so that said plunger and said heater piston are normally in the downstroked position and will move upwardly in the stepping motion when the force of the received sonic pressure waves are added to the counterbalancing biasing force.

17. A pump as claimed in claim 16 wherein said plunger comprises:

(a) a piston body in an intermediate portion of the bore of said housing;

(b) a cylindrical sleeve extending axially upwardly from said piston body so that the upper end of the axial bore of said plunger opens into the upper end of the bore of said housing;

(c) first seal means in said housing for engaging the periphery of said cylindrical sleeve and separating the upper end of the bore of said housing from the intermediate portion thereof;

(d) a tubular stem depending axially from said piston body to locate the lower end of said plunger in the lower end of the bore of said housing;

(e) second seal means in said housing for engaging the periphery of said tubular stem and separating the intermediate portion of the bore of said housing from the lower end thereof;

(f) said tubular stem having radial passages which open from the axial passage of said plunger into the intermediate portion of said housing under said piston body but above said second seal means so that the head pressure forces of the liquid column of said pump will be in communication with both the upper end surface of said cylindrical sleeve and the bottom end surface of said piston body; and (g) said upper end surface of said cylindrical sleeve having a smaller area than the surface area of the bottom end surface of said piston body.

18. A sonic pressure wave operated pump for heating and elevating subterranean high viscosity oil, said pump having a column of liquid and comprising:

(a) a generator for cyclically impacting the column of liquid for generating a sonic of since pressure waves;

(b) an electrically conductive tube coupled to receive the generated sonic waves from said generator and transmit them to the subterranean level;

(c) pump means on the lower end of said tube for impingingly receiving the generated sonic waves and reflecting them upwardly through said tube for carrying the oil to be elevated therewith, said pump means including operating means reciprocally movable in a series of steps in one direction in response to the impinging sonic pressure waves and having means for biasing of said operating means in the opposite direction;

(d) control means interposed between said generator and said tube and having an oil outlet, said control means having a normal first position wherein the generated sonic waves are directed into said tube and the reflected sonic waves and the oil carried thereby are blocked from reaching the oil outlet of said control means and having a second position wherein the generated sonic waves are blocked from reaching said tube and the reflected sonic waves and the oil carried thereby are in communication with the oil outlet of said control means, said control means being movable from its normal first position to its second position when the hydrostatic pressure in said tube builds up to a predetermined value; and (e) said pump means being in communication with the oil to be heated and elevated for intaking the oil as a result of the reciprocal operation of said operating means, said pump means further including, I. a sleeve housing defining an axial bore and formed of non-permanently magnetizable material having alternately arranged annular grooves and fins formed axially along its peripheral surface, II. a heater piston in the bore of said sleeve housing and coupled to said operating means for reciprocal movement therewith, said heater piston having magnet means defining a plurality of polar regions arranged to be in a repelling attitude with respect to each other for generating heat when said heater piston is reciprocally moved in the axial bore of said sleeve housing.

19. A sonic pressure wave pump as claimed in claim 18 wherein said magnet means of said heater piston is in the form of a plurality of magnets and said heater piston includes means for fixedly holding said plurality of magnets in constrained contention with each other.

20. A sonic pressure wave pump as claimed in claim 18 wherein said magnet means of said heater piston is in the form of a single magnet which is formed with this plurality or polar regions therein with the forming being accomplished so that the plurality of polar regions are in contention.

21. A sonic pressure wave pump as claimed in claim 18 wherein said magnet means of said heater piston includes a plurality of individual magnets at least one of which is free to move in a jiggling motion.

22. A sonic pressure wave pump as claimed in claim 18 wherein said heater piston comprises:

(a) magnet mounting means defining an axis;

(b) a pair of magnets fixedly mounted by said magnet mounting means in spaced apart relationship along the axis defined thereby; and (c) at least one additional magnet loosely mounted by said magnet mounting means in the space between said pair of magnets for free jiggling movement within the space between said pair of fixedly mounted magnets.

* * * * *